US007678450B2

(12) United States Patent
Kitamura et al.

(10) Patent No.: US 7,678,450 B2
(45) Date of Patent: Mar. 16, 2010

(54) SEWING THREAD AND PROCESS FOR PRODUCING THE SAME

(75) Inventors: Haruki Kitamura, Aichi (JP); Toshihiko Kimura, Shiga (JP); Kazuo Umeda, Shiga (JP); Yoshikazu Tsuji, Shiga (JP); Naoki Yamaga, Shiga (JP); Akihiro Maekawa, Shiga (JP)

(73) Assignee: Toray Industries, Inc., Tokyo (JP)

( * ) Notice: Subject to any disclaimer, the term of this patent is extended or adjusted under 35 U.S.C. 154(b) by 1127 days.

(21) Appl. No.: 10/510,336

(22) PCT Filed: Apr. 3, 2003

(86) PCT No.: PCT/JP03/04276

§ 371 (c)(1),
(2), (4) Date: May 19, 2005

(87) PCT Pub. No.: WO03/085181

PCT Pub. Date: Oct. 16, 2003

(65) Prior Publication Data

US 2005/0202240 A1 Sep. 15, 2005

(30) Foreign Application Priority Data

Apr. 5, 2002 (JP) ..... 2002-103443

(51) Int. Cl.
*D02G 3/22* (2006.01)
*D02G 3/26* (2006.01)
*D02G 3/28* (2006.01)
*D02G 3/34* (2006.01)
*D02G 3/46* (2006.01)

(52) U.S. Cl. ..... 428/370; 57/210; 57/236; 57/238; 57/239; 57/245; 57/246

(58) Field of Classification Search ..... None
See application file for complete search history.

(56) References Cited

U.S. PATENT DOCUMENTS 3,763,640 A * 10/1973 Nagel et al. ..... 57/6
6,074,751 A * 6/2000 Murakami et al. ..... 428/373

FOREIGN PATENT DOCUMENTS

WO WO 03/085181 A1 10/2003

OTHER PUBLICATIONS

Form PCT/IB/308 (Apr. 2002).
Form PCT/ISA/210 (Jul. 1998).

* cited by examiner

*Primary Examiner*—Jennifer A Chriss
(74) *Attorney, Agent, or Firm*—Pillsbury Winthrop Shaw Pittman LLP

(57) ABSTRACT

To provide a sewing thread that is excellent in high-speed sewability and automatic sewing characteristics. A sewing thread includes a plurality of under-twisted yarns provided with upper-twist, the yarns each being composed of a sheath-core structure yarn composed of two or more multifilament yarns, wherein part of the sheath-core structure yarn protrudes as loops on a yarn surface, the loops being composed of 50 to 300 loops/m with 0.7 to less than 1.2 mm length and 10 or less loops/m with 1.2 mm or more length, and wherein the yarns have a strength of 4 to 6 CN/dtex.

11 Claims, 5 Drawing Sheets

SEWING THREAD AND PROCESS FOR PRODUCING THE SAME

TECHNICAL FIELD

The present invention relates to a sewing thread composed of a synthetic fiber multifilament having loops and being sewable in high-speed, and a process for producing the sewing thread.

BACKGROUND ART

Sewing threads composed of a multifilament yarn have been widely used because of the excellence in mightiness, wear resistance, and uniformity in comparison with sewing threads composed of short fibers. Among them, several proposals have been made in that sewability is improved by processing filaments with fluid into a filament textured yarn, such as a spun yarn having loops.

In Japanese Unexamined Patent Application Publication No. 62-257434, a thread is proposed, which is processed with a fluid turbulent. processor so as to have difference in yarn length for forming loops. However, this thread is expensive in processing because of the. fluid turbulent processor, and also because of many uneven fine loops, and there have been problems of low process-passage efficiency, such as unreeling failure produced in a twisting process and a sewing process, and reduction in mightiness.

This is because one filament of single. fiber forms a torsional loop so as to stiffly protrude from a yarn surface, so that the loop is difficult to contribute to yarn strength, and produces strong fastener effect when the yarn is unreeled. This. becomes a fatal defect so that there is no prospect of a practical application as a sewing thread.

Japanese Unexamined Patent Application Publication No. 5-106134 discloses a composite sewing machine thread in that the ductility difference between a spontaneous ductile filament yarn and a non-spontaneous ductile filament yarn forms loops and slack. However, the fineness of the loop and slack is small and the number of the loops is scarcely counted, so that accompanying airflow effect and annealing effect of needle heat are small, and the thread is insufficient to have high-speed sewability.

on the other hand, a conventional cotton sewing thread having excellent sewability has been widely used as home sewing threads and industrial sewing threads. However, the mightiness is small and dyeing fastness is also insufficient. Moreover, this thread has defects, such as being susceptible to dimensional change and insufficient seam appearance. On the other hand, a polyester spun sewing-thread enjoying a large market share of sewing threads has the sewability similar to the cotton, and also is excellent in mightiness, dyeing fastness, and dimensional stability. However, since it is produced by a spinning process, there are problems in length control and quality control, such as large variations in gauge and mightiness, and a large number of knots, so that the thread is difficult to be used for sewing high-quality cloth because of its low appearance quality.

A sewing thread produced from filament yarns of silk, polyester, and polyamide has been widely used as a sewing thread in order correct the defects of cotton and polyester spun sewing threads. A conventional filament sewing thread is produced by providing upper-twist to a plurality of aligned single yarns provided with under-twist, and its physical characteristics can be obtained in accordance with the fineness of the single yarn and the overall fiber fineness of the sewing thread, so that it has stable quality.

However, with a conventional filament sewing-thread, in the general sewing, i.e., the forward sewing with a lock stitch sewing machine, the thread can be favorably sewn, whereas, in the backward sewing, since a force is applied in a direction canceling the upper-twist, twist crack and broken yarn occur, so that the thread has a fatal defect that the thread cannot be applied to automatic machine sewing, in which the backward sewing is frequently incorporated. In high-speed sewing with an industrial sewing machine, since the frictional resistance on the side face of the filament yarn is large, broken yarns are liable to be generated by needle heat and the penetration resistance against cloth. This corresponds to no suppressing effect on needle heat temperature mentioned above.

Then, several sewing threads, in which the problems of conventional spun sewing threads and filament sewing threads are solved, have been proposed. A core-spun sewing thread having a sheath-core structure of a filament yarn and a spun yarn has been proposed in Japanese. Examined Patent Application Publication No. 63-3977; a sewing thread with sewability improved by union twisting of a spun yarn and a filament yarn has been proposed in Japanese Unexamined Patent Application Publication No. 2-33341.

However, these sewing threads also have knots and variations in gauge since it is produced by a spinning process as mentioned above, containing a defect that broken yarns are liable to be generated in sewing.

In order to apply fluffiness and bulkiness like in a spun yarn to a synthetic-fiber multifilament yarn, several threads processed by fluffing filament yarns are proposed. A fluffing method has been proposed in Japanese Unexamined Patent Application Publication No. 3-64546 and No. 8-337937 in that after under-twist or upper-twist is provided, a multifilament yarn is looped around a guide, and the yarn approaching the guide and the way back yarn are crossed to each other so as to apply the fluffiness to both the yarn by bearing down on them. However, in the sewing threads obtained by these methods, although they have the fluffiness like a spun filament, a load due to the crossing process to multifilament yarns is large for the sewing thread, so that the backward sewability is especially low and the yarn strength is insufficient.

DISCLOSURE OF INVENTION

The present invention provides a sewing thread composed of a textured yarn processed by providing loops to a synthetic-fiber multifilament yarn and having high-speed sewability, and its producing method.

The sewing thread achieving the above object has the following structure.

That is, a sewing thread includes a plurality of under-twisted yarns having upper-twist provided therewith, each of the yarns being a sheath-core structure yarn composed of two or more multifilament yarns, wherein part of the sheath-core structure yarn protrudes as loops on a yarn surface, the loops with 0.7.to less than 1.2 mm length are 50 to 300 loops per meter, the loops with 1.2 mm or more length are 10 or less loops per meter, and the sewing thread has a strength of 4 to 6 cN/dtex.

In such a manner, since the sewing thread has a number of loops with 0.7 to less than 1.2 mm length, the frictional resistance between the thread and a needle is reduced during sewing, so that accompanying airflow effect and annealing effect of needle heat mentioned above are increased, obtaining the sewing thread having high-speed sewability.

Also, a process for producing sewing threads includes the steps of preparing core yarns from multifilament yarns with an overfeed rate of 0.5 to 5%; preparing sheath yarns from multifilament yarns with an overfeed rate of 3.5 to 25%; combining and entangling the core yarns and the sheath yarns; under-twisting the combined and entangled yarns; aligning a plurality of under-twisted yarns; and upper-twisting the under-twisted yarns. Since a combined and entangled textured yarn is under-twisted and then, is upper-twisted in such a manner, while the size of the loop of the sewing thread can be freely designed, the high strength due to the entanglement can be obtained. Since the sewing thread according to the present invention has 50 to 300 loops per meter with 0.7 to less than 1.2mm length and 10 or less loops per meter with 1.2 mm or more length, there are a great number of micro loops and the yarns have a large strength of 4 to 6 cN/dtex, so that accompanying airflow effect and annealing effect of needle heat are great, as well as wear resistance is large, obtaining sufficient sewability even at a high speed.

In comparison with spun threads, the yarn strength is larger and also the mightiness of seam is increased because the core yarn and the sheath yarn of the filament yarn constituting the under-twisted yarn are connected together by the entanglement, so that the sewing thread has an advantage of difficulty in seam breaking. Furthermore, this sewing machine thread has excellent sewability in automatic sewing machines, i.e., being capable of not only forward sewing but also backward sewing, regardless of the sewing thread composed of the filament yarn.

REFERENCE NUMERALS AND CHARACTERS

1: sheath filament yarn, 2: core filament yarn, 3: feed rollers, 4: feed rollers, 5: entangling nozzle, 6: picking rollers, 7: heater, 8: relaxing rollers, 9: reeling roller, 10: cheese, A: single loop of one single filament, B: loop of a plurality of single filaments, C: separator, I: fluid nozzle, N: sewing thread having loops, Y: yarn inlet, Y1, Y2: yarn, Ye: yarn outlet, Yt: fluid processor.

BEST MODE FOR CARRYING OUT THE INVENTION

Figure 1A:
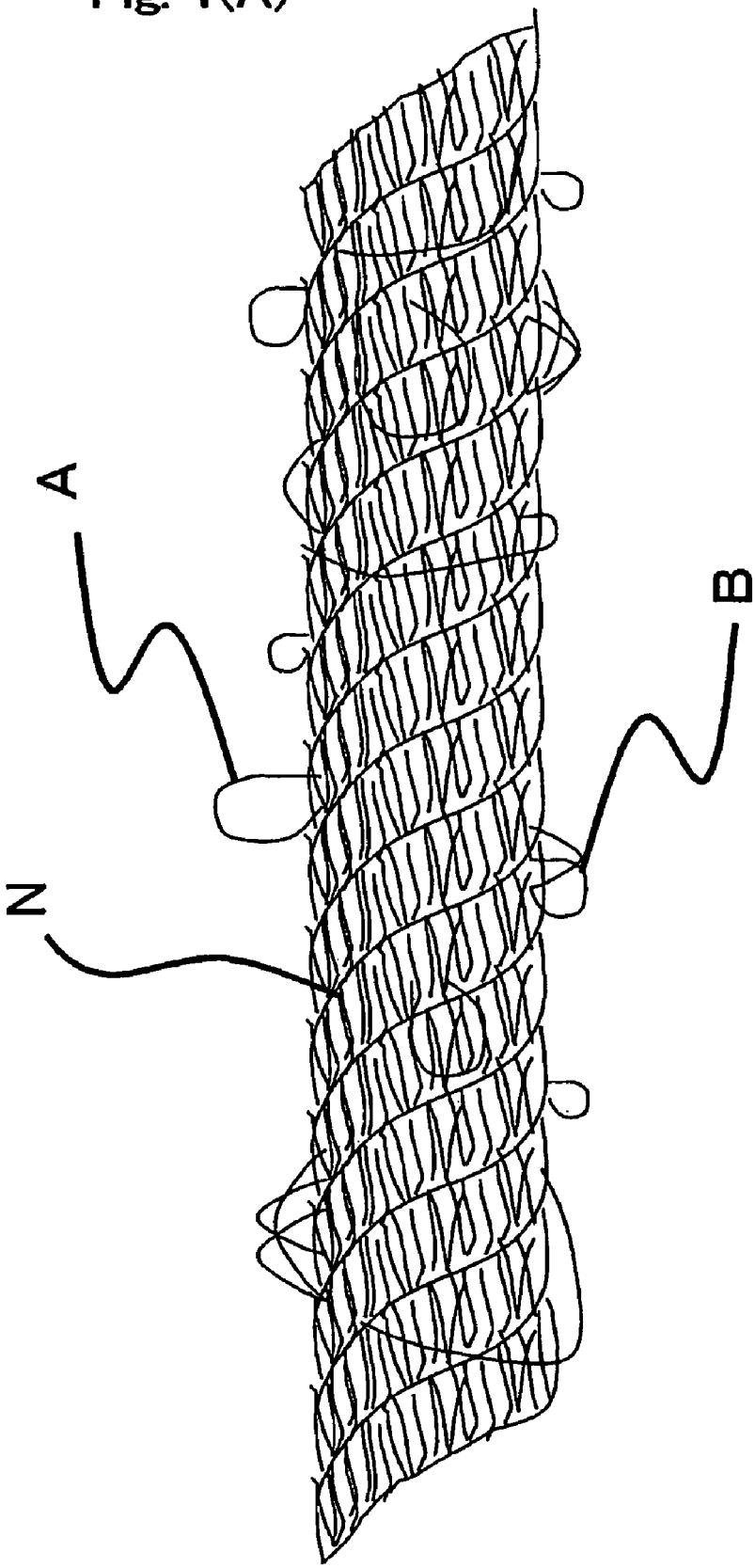
FIG. 1(A) is a schematic view of an example of a sewing thread according to the present invention.
Figure 1B:
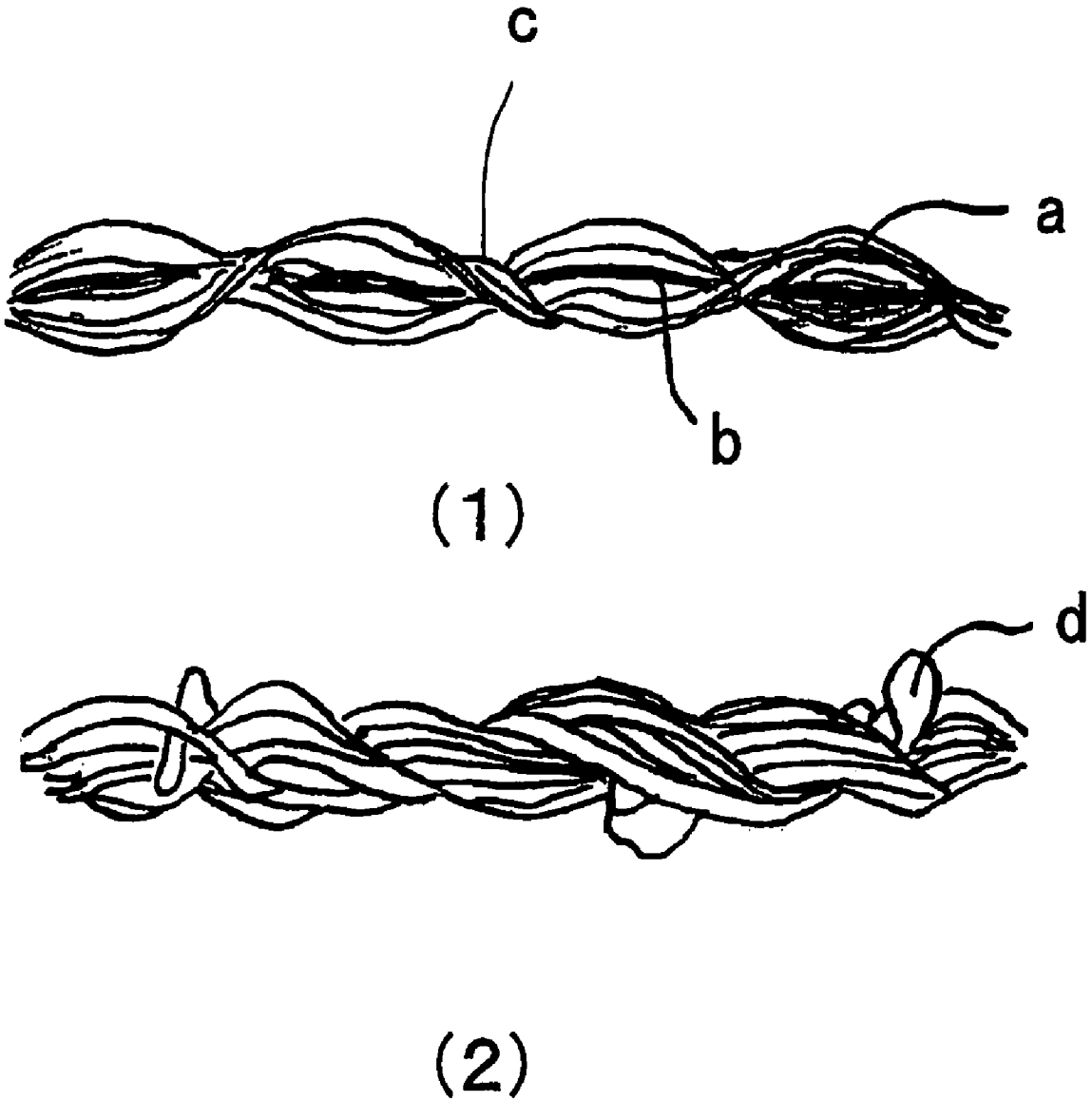
FIG. 1(B) is a schematic view of an example of a multifilament yarn composed of two multifilament yarns before under-twist.

A sewing thread according to the present invention will be described below with reference to the drawings. FIGS. 1(A) and 1(B) are schematic views respectively showing a sewing thread according to the present invention and an example of a multifilament composed of two multifilament yarns constituting the sewing thread before under-twist.

In FIG. 1(A), a sewing thread N includes a plurality of under-twisted yarns, each yarn being composed of two or more multifilament yarns with difference in filament length, having upper-twist provided therewith. Each multifilament is composed of a plurality of monofilaments, and parts of the monofilaments are entangled and protruded in a longitudinal direction to be loops. These loops are restricted with under-twist and upper-twist so that there are (A) a loop formed with one monofilament and (B) a loop formed with a plurality of monofilaments.

The number of loops protruded from the surface of the sewing thread and having lengths in the range of 0.7 to less than 1.2 mm is in the range of 50 to 300 piece/m, and the number of loops with lengths of 1.2 mm or more is 10 pieces/m or less. In such a manner, since a large number of loops, 50 pieces/m or more, with lengths of 0.7 to less than 1.2 mm exist, sufficient high-speed sewability can be obtained because of accompanying airflow effect and high annealing effect of needle heat.

However, with 300 pieces/m or more, variation in sewing tension of the sewing thread is increased so that the sewability and yarn strength are unfavorably reduced.

In FIG. 1(B), (1) shows a multifilament composed of two multifilament yarns before under-twist, in which reference character a denotes a filament to be a sheath yarn; character b denotes a filament to be a core yarn; character a also shows a filamentated portion; and character c shows an entangled convergence portion.

In FIG. 1(B), (2) shows a sewing thread according to the present invention that is fabricated by providing upper-twist in the Z direction to two of the multifilament yarn shown in (1), which are aligned after under-twisting in the S direction, wherein character d shows a loop shape.

When the sewing thread shown in (2) is renatured from upper-twist and under-twist, it is returned to the multifilament of two filaments shown in (1).

Features of loops in the sewing thread according to the present invention will be described in detail with reference to FIG. 2.

The number of loops in the present invention means the total sum of parts of one monofilament in the multifilament composed of two or more multifilament yarns constituting an under-twisted yarn, which are protruded by the entanglement in the longitudinal direction so as to form loops on the surface of the yarn by the restriction of under-twist and upper-twist (like the loop A in FIG. 1(A)), parts of a plurality of monofilaments among the multifilament of two or more filaments constituting an under-twisted yarn, which are uniformly protruded by the entanglement in the longitudinal direction so as to form loops on the surface of the yarn by the restriction of under-twist and upper-twist (like the loop B in FIG. 1(A)), and slacks.

The number of loops according to the present invention is determined by measuring the number of loops or slacks before loops generated by under-twisting and upper-twisting the filamentated portions a shown in FIG. 1(B) formed by a fluid entangling process. The loops formed by a fluid turbulent process, as mentioned above, have torsion or already have loops before under-twist and upper-twist. These loops are hardened by under-twisting and upper-twisting so as to protrude furthermore, producing great fastener effect as described above.

The number of loops may be measured in practice using HAIRNESS COUNTER MODEL DT-104 from Toray Engineering Co. Ltd. at a yarn running speed of 60 m/min.

When the number of loops with lengths ranged from 0.7 mm to less than 1.2 mm becomes less than 50 pieces/m, accompanying airflow effect and annealing effect of needle heat cannot be obtained. Also, when the number of loops with lengths of 1.2 mm or more becomes 10 pieces/m or more, the thread is deteriorated in appearance to have slab tone, and problems arise as well, such as inferior needle penetration and broken threads.

Figure 2:
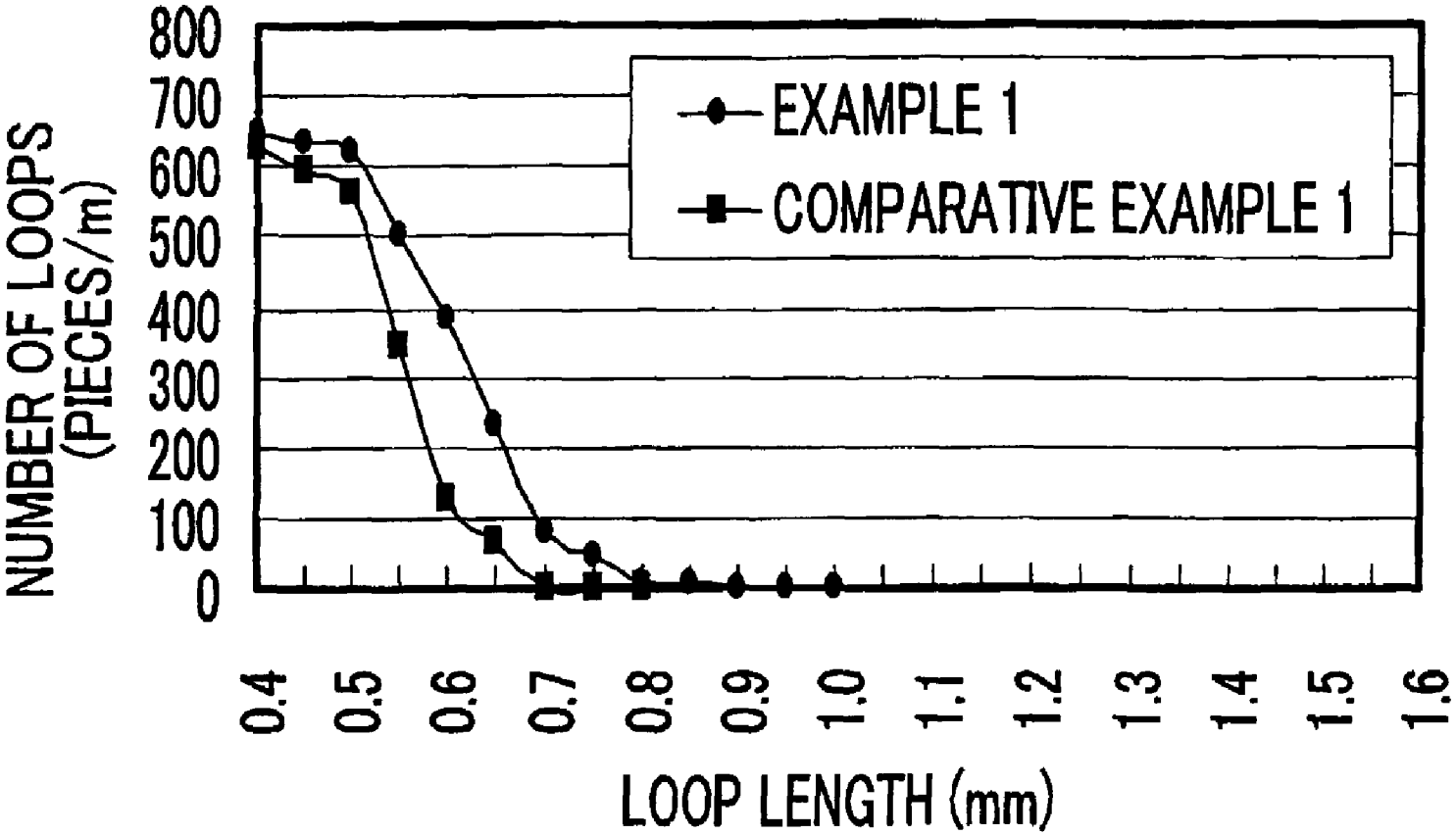
FIG. 2 is a graph of the relationship between a loop length and the number of loops regarding to each thread of EXAMPLE and COMPARATIVE EXAMPLE.

FIG. 2 shows the relationship of a loop length and the number of loops between EXAMPLE 1 which is an example of the sewing thread according to the present invention (the sewing thread obtained in EXAMPLE 1 which will be described later) and COMPARATIVE EXAMPLE 1, in which no difference in yarn length is provided (the sewing thread obtained in COMPARATIVE EXAMPLE 1 which will be described later).

Data in FIG. 2 are obtained using HAIRNESS COUNTER MODEL DT-104 from Toray Engineering Co. Ltd. at a yarn running speed of 60 m/min. The number of loops (pieces/m) in ordinate of FIG. 2 means the number of loops with lengths of more than the value plotted in abscissa.

Thus, in the sewing thread according to the present invention, that the loops with lengths from 0.7 mm to less than 1.2 mm are 50 to 300 pieces/m means that the value of the number of loops in ordinate of FIG. 2 at the loop length 0.7 in abscissa subtracted by the number of loops at lengths of 1.2 mm or more is 50 or more.

Also, in the sewing thread according to the present invention, that the loops with lengths of 1.2 mm or more are 10 pieces/m or less means that when the loop length in abscissa of FIG. 2 is 1.2 mm, the number of loops in ordinate is 10 or less.

On the other hand, as is apparent from FIG. 2, even in COMPARATIVE EXAMPLE 1 which has no yarn-length difference and no loop, torsion and waviness may be produced on the yarn surface by providing under-twist and upper-twist, so that the number of loops can be detected therefrom. However, COMPARATIVE EXAMPLE 1 has distribution in that the number of loops with lengths of 0.7 mm to less than 1.2 mm is extremely small. Hence, the sewing thread from COMPARATIVE EXAMPLE 1 has no functions of accompanying airflow effect and annealing effect of needle heat, so that sufficient high-speed sewability cannot be obtained.

Whereas, the sewing thread according to the present invention, as shown in FIG. 2, has a large number of loops in the loop length range of 0.5 mm to less than 1.2 mm, so that accompanying. airflow effect and annealing effect of needle heat are large, and sufficient high-speed sewability can be obtained even at a high speed.

The sewing thread according to the present invention is fabricated from multifilament yarns which are under-twisted after providing the difference in yarn length, and further upper-twist is provided thereto, so that the yarn mightiness is increased so as to have a breaking strength of 4 to 6 cN/dtex. Because of such a high yarn mightiness, not only sufficient high-speed sewability can be obtained even in using for the sewing thread, but also automatic sewability can be considerably improved.

In general, a high-mightiness filament yarn (the twisted yarn provided with under-twist and upper-twist) having no loop produced with the difference in yarn length has a breaking strength of 6 to 7 cN/dtex; however, the high-speed sewability and the automatic sewability are extremely deteriorated especially in using the yarn for the sewing thread. The reason is that because of no loop and no pile, generated accompanying airflow is small and a frictional resistance is large between the thread and a needle, thereby heating the needle so as to melt and break the thread frequently with the needle heat. The yarn strength according to the present invention is measured in conformity with the standard of JIS L-1073.

The number of filaments constituting a multifilament yarn constituting the sewing thread according to the present invention is preferably six or more as the number of monofilaments per one multifilament yarn in view of generating sufficient loops. In view of preventing nep and disturbance from being generated on a yarn surface, the number of filaments is preferably 200 or less per one multifilament yarn.

The material of the filament constituting the sewing thread according to the present invention is not especially limited as long as it is a synthetic fiber; however, it is preferable to use a thermoplastic synthetic filament, such as polyester and nylon, with low ductility and high strength. An overall fiber fineness of the multifilament yarn is preferably 80 to 500 denier.

The cross-section of the monofilament is generally circular; alternatively, it may have a modified cross-section, such as a triangle, a pentagon, a hollow shape, and a flat shape. It may also employ a special type, such as high gloss and low gloss.

The kind of a multifilament strand constituting a under-twisted yarn of the sewing thread is preferably one or two; however, it may be three or more. The under-twisted yarn may also be composed of a textured yarn having sheath-core structure loops and multifilament strands mixed therewith.

The difference in yarn length applied upon combining and entangling multifilament strands constituting the under-twisted yarn of the sewing thread may preferably be in the range of 2 to 20% in order to obtain accompanying airflow effect and high annealing effect of needle heat so as to have sufficient sewability even at a high-speed. If the yarn-length difference is less than 2%, the length of a loop produced on the yarn surface of the sewing thread is excessively small, so that accompanying airflow effect and high annealing effect of needle heat are reduced, deteriorating high-speed sewability. If the yarn-length difference is more than 20%, upon applying the yarn-length difference, slack is generated in a sheath yarn on an inlet side of a nozzle, so that the application becomes instable. Also, the length of the loop produced on the yarn surface of the sewing thread is excessively large, so that not only hung-up at a needle hole is generated, but also the thread is deteriorated in appearance to have slab tone and in appearance of sewn products. The yarn-length difference means the value of the overfeed rate of a multifilament yarn to be a sheath yarn subtracted by the overfeed rate of a multifilament yarn to be a core yarn.

The combining and entangling according to the present invention is to entangle a plurality of multifilament yarns using an interlace nozzle so as to alternately form a filamentated portion and an entangled portion as shown in FIG. 1(B). However, in the combining and entangling state, no loop is produced. Incidentally, the combined filament yarn continuously entangled using a turbulent nozzle already has loops formed thereon.

An average coefficient of variations in sewing tension is measurements of variations in sewing tension when cloth is sewn with a sewing machine, which is a point directly affecting the unreeling tension of the thread.

When the variations in sewing tension are small, broken threads are reduced in sewing so as to improve sewability, and puckering of a product is reduced so as to lead to quality improvement.

The average coefficient of variations in sewing tension according to the present invention is within ±10%, and if it is in excess of this, as mentioned above, reduction in sewability and the puckering are unfavorably increased.

Next, a process for producing the sewing thread according to the present invention will be described. In a textured yarn constituting an under-twisted yarn, a multifilament yarn of a core yarn is fed to a fluid processor at an overfeed rate of 0.5 to 5% while the multifilament yarn of a sheath yarn is fed to the fluid processor at an overfeed rate of 3.5 to 25% so as to combine the core yarn with the sheath yarn and entangle them.

Figure 3A:
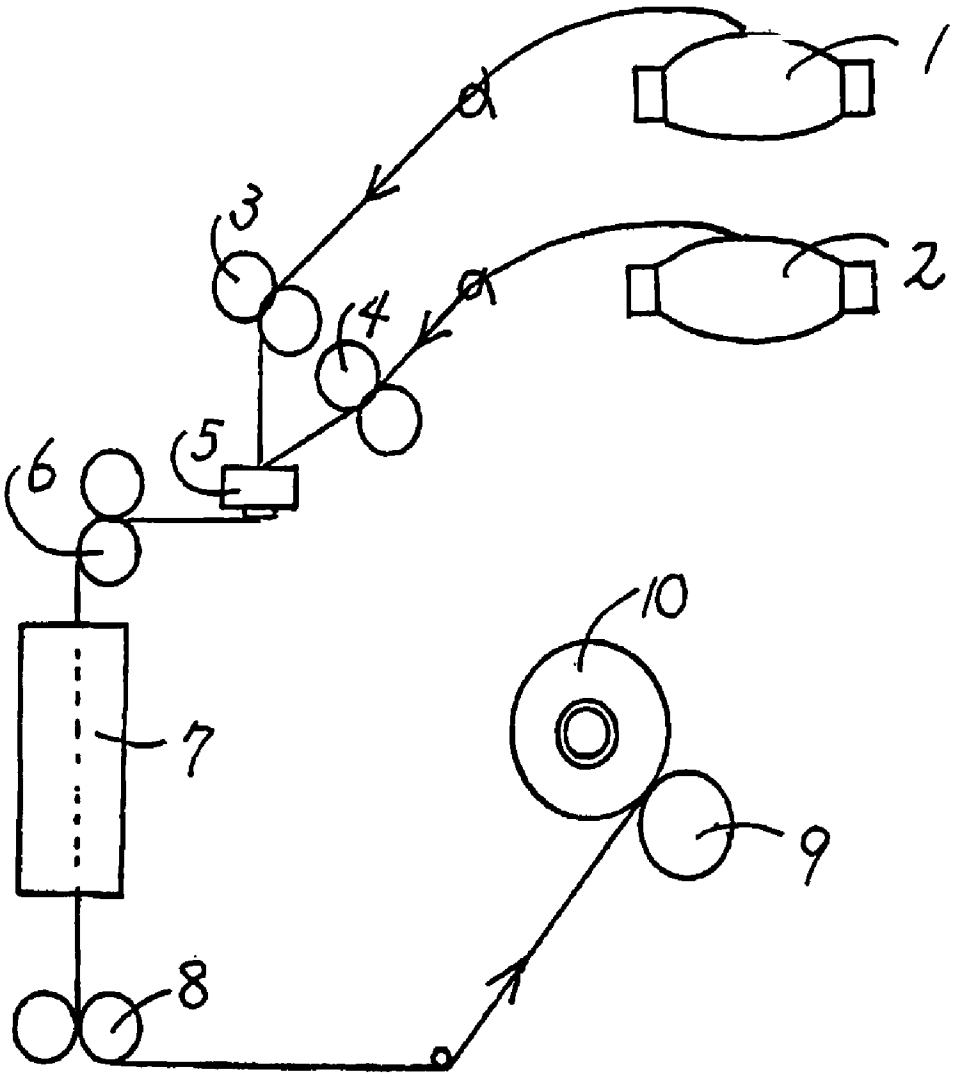
FIG. 3(A) a process schematic drawing of an example producing process of a multifilament yarn according to the present invention.

FIG. 3(A) is a schematic view showing an example of a process for producing the multifilament yarn of the sewing thread according to the present invention before providing under-twist.

A filament yarn 1 to be the core yarn is unreeled from a bobbin and is fed to feed rollers 3 while a filament yarn 2 to be a sheath yarn is unreeled from a bobbin and is fed to feed rollers 4 so as to entangle both the filaments at an entangling nozzle 5 for producing the multifilament yarn by pulling them out of picking rollers 6.

In order to reduce loops with bulky sizes of the multifilament yarn, heat setting may be carried out between the picking rollers 6, a heater 7, and relaxing rollers 8. Alternatively, without the heat setting, the multifilament yarn may be produced by reeling it on a cheese 10 via a reeling roller 9.

In the overfeed rates of the core yarn and the sheath yarn for feeding to the feed rollers, if the overfeed rate of the core yarn is less than 0.5%, filamentation is insufficient during the combination and entanglement, so that the yarn is poorly combined. If the overfeed rate of the core yarn is over 5%, slack is generated in the fluid processor so that the process becomes instable.

If the overfeed rate of the sheath yarn is less than 3.5, the yarn-length difference to the core yarn cannot be sufficiently applied. If it is over 20%, as mentioned above, the length of the loop produced on the yarn surface of the sewing thread is large, so that hung-up at a needle hole may be generated.

According to the present invention, fluid used for applying the yarn-length difference to the sewing thread, air is preferable in view of reduction in production cost; alternatively, fluid may be ejected after applying water to the yarn. A device for entangling the core yarn and the sheath yarn having the yarn-length difference, as shown in the perspective view of FIG. 3(B), preferably is a nozzle for multifilament yarn with a separator for restricting the distance from an inlet introducing the two yarns thereinto to a merging point.

In a combining process using a conventional nozzle without the separator, slack due to the yarn-length difference generated in a fluid-processed portion of the sheath yarn spreads to the core yarn, so that the entire yarn is relaxed and the combining process becomes instable.

Whereas, in a nozzle according to the present invention, by the function of a separator for separating the core yarn and the sheath yarn, spread of the slack to the core yarn is suppressed so that the combining can be stably carried out. In particular, in the combining of the core yarn and the sheath yarn at a high overfeed-rate, this effect is remarkable.

Figure 3B:
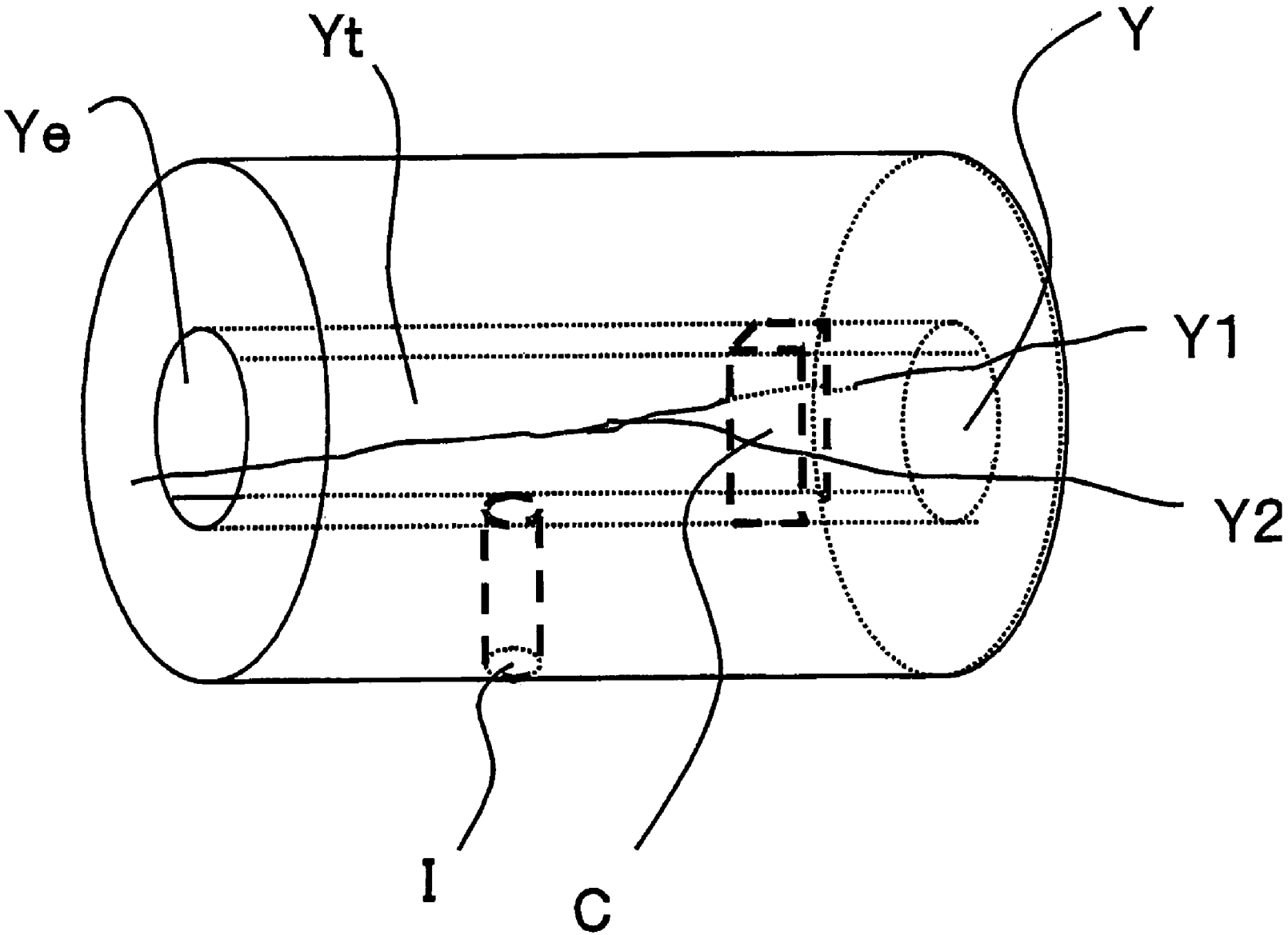
FIG. 3(B) is a perspective view showing an example of a nozzle for chemical synthetic fibers preferred to the present invention.

A nozzle shown in FIG. 3(B) includes a yarn inlet Y, a yarn outlet Ye, and a fluid nozzle I. The yarn is introduced from the yarn inlet Y to the nozzle and is combined by fluid ejected from the fluid nozzle I and is discharged out of the nozzle from the yarn outlet Ye. Between the yarn inlet Y and the fluid nozzle I, a separator C is provided so as to restrict the distance from an inlet introducing the two yarns thereinto to a merging point.

As shown in FIG. 3(B), by allowing the core yarn and the sheath yarn to flow together with air at the direct vicinity of a fluid-ejecting nozzle so as to entangle them, a bulky combined filament yarn with the yarn-length difference can be obtained. The distance between the fluid-ejecting nozzle and the merging point of the core yarn and the sheath yarn preferably is 0.5 mm or more in view of suppressing to form a nep yarn (knot). The distance between the fluid-ejecting nozzle and the merging point of the core yarn and the sheath yarn preferably is 10 mm or less in view of suppressing the slack of the entire yarn at the inlet of the nozzle, which is caused by slack of the sheath yarn due to the yarn-length difference spreading to the core yarn. It is more preferable that the distance be in a range of 1 mm to 5 mm.

As a shape of the separator C of FIG. 3(B), a circular cylinder, a triangular pyramid, and a hollow thread-guide pipe may be employed. Among them, a circular cylindrical pin is most preferable in view of processing the yarn.

According to the present invention, the number of the yarns aligned in an under-twist providing process before upper-twist may be two or more. It may preferably be 2 to 7. In view of improving balance, it is more preferable to be two for a clothing material and 3 to 7 for a sewing machine thread. The number of under-twists of filament yarns aligned together may be different from each other, and the directions of under-twisting may be different from each other.

It is preferable that in the relationship between the number of upper-twists and the number of under-twists, a twisting direction and a number of twists be established so as to maintain the balance of twisting torques when the sewing thread according to the present invention is processed. It is preferable that the under-twisting direction and the upper-twisting direction be opposite to each other and the number of the upper-twists be 60 to 90% of the number of the under-twists. In view of obtaining sufficient sewability considering the convergence of the sewing thread according to the present invention, it is preferable to apply a twist coefficient k of 4000 or more to the thread if the number of the under-twists is represented by the twist coefficient. On the other hand, in view of preventing the hardening of the sewing thread as well as reducing cost in the twisting process, it is preferable to apply a twist coefficient k of 12000 or less, and it is more preferable to apply it in a range of 7000 to 11000. In general, a sewing thread is set to bringing up twist on demand after twisting, and then, dyeing and finishing are performed. The dyeing is generally carried out in a hank or a cheese type. The twist coefficient k is obtained from the following equation:

$$\text{twist coefficient } k = T \cdot D^{1/2}$$

where T: the number of twists per 1 m (pieces/m)

D: fineness (dtex).

The sewing thread according to the present invention is not limited to the yarn count, i.e., the gauge of the sewing thread; however, as for a clothing material, #80 , #60, and #50 may be used for a general-purpose sewing thread and thicker threads than these may be used for an industrial material. The number of filaments of a base fiber constituting the sewing thread may be appropriately set in accordance with the fineness of the monofilament.

EXAMPLE

The evaluation (Table 1) of the sewability of the sewing thread in EXAMPLE is performed regarding the following items.

(a) The high-speed sewability

The sewing speed (needles/tin) in that 10 sheets of cotton broad cloth overlapped on each other can be sewn using a lock stitch sewing machine in a distance of 2 m without a broken thread 5 times continuously is shown in the table. The sewing machine used is JUKI DDL-5571N and the sewing-machine needle used is ORGAN DB×1 #11.

(b) The back sewability

The sewing speed (needles/min) in that 4sheets of cotton broad cloth overlapped on each other can be sewn using a lock stitch sewing machine in a distance of 2 m without a broken thread 5 times continuously is shown in the table. The sewing machine used is JUKI DDL-5571N and the sewing-machine needle used is ORGAN DB×1 #11.

(c) The average coefficient of variations in sewing tension t (%)

The yarn tension when sewing cloth at a needle revolving speed of 3000 rpm (sewing speed of about 7.5 m/min) using a lock stitch sewing machine is measured with a tension meter DFG-0.5KJ from SHIMPO Instruments 10 times at a needle bar of the lock stitch sewing machine.

The average coefficient of variations in sewing tension t (%) is calculated from an average tension (x) for 10 times, an average maximum tension (ma), and an average minimum tension (mi) using the following equation. The average coefficient of variations in sewing tension t is preferable within ±10% in view of the sewing tension stability, and in a thread with the coefficient of over 10%, the machine is difficult to be adjusted, leading to a sewing failure.

The average coefficient of variations in sewing tension $t(\%)=\{(ma-mi)\times 0.5/x\}\times 100$.

(d) The dry-heat shrinkage ratio s (%)

The hank length is measured under a load of 0.1 cN/detex at room temperature to have L1. In thermal treatment equipment, a sample is heated at a temperature of 180° C. for 5 minutes under a load of 0.002 cN/dtex, and after it is taken out of the equipment, the hank length is measured under a load of 0.1 cN/detex at room temperature to have L2. From these factors, the dry-heat shrinkage ratio s is calculated with the following equation:

The shrinkage ratio $s(\%)=\{(L1-L2)/L1\}\times 100$.

(e) The boiling-water shrinkage ratio, the fineness, the strength, the elongation These factors are measured in conformity with JIS L1090.

In the measurement methods of a tensile strength and a hooking strength, the tensile strength S1 is obtained using a tensile tester (MODEL-1122 made by INSTRON Corporation) with a sample length of 20 cm and at a tensile speed of 20 cm/min, and the tensile strength S2 is obtained under the same conditions as the above while the sewing machine thread is linked in "pile" so as to pull each other.

The tensile strength (cN/dtex) S1

The hooking strength (cN/dtex) S3=S2/2

The hooking-strength availability (%) $(S3/S1)\times 100$ (f) The number of entanglements A vat of about 50 cm square is prepared on which bottom a black board is placed and water is poured at a height of 5 cm. On the water, a combined yarn constituting under-twisted yarn entangled thereon is floated, and the number of entangled portions is read so as to calculate numbers, converted to the number per 1 m as an average. The number n is 10.

(g) The yarn-length difference

A sample yarn with a length of 5 cm is taken under a load of 0.1 cN/dtex, and then it is separated into a core yarn and a sheath yarn. A weight of 0.1 cN/dtex is hung on the sheath yarn, and a yarn length L1 is read. The difference in yarn length is represented by:

The yarn-length difference $(\%)=\{L1-5)/5\}\times 100$ (the average of n=10 measurements).

Example 1

Two high-mightiness polyester multifilament yarns with 6.2 cN/dtex (56 dtex−18 filaments) were entangled and combined by fluid at a core-yarn overfeed rate of 3% and at a sheath-yarn overfeed rate of 8% using a nozzle for chemical synthetic yarns shown in FIG. 3(B) so as to obtain a sheath-core structure yarn with a yarn-length difference between the core yarn and the sheath yarn of 5% (the nozzle pressure: 0.4 MPa). The sheath-core structure yarn was under-twisted in the s direction at 1010 T/m with a down twister, and then, the aligned two sheath-core structure yarns were upper-twisted in the Z direction at 758 T/m with the down twister. Then, after heat treatment at a temperature of 180° C., the sewing thread was dyed in a cheese state, and re-reeled on a bobbin for a sewing thread while oil being applied thereon. The characteristics of this sewing thread having loop distribution shown in EXAMPLE 1 of FIG. 2 are as follows:

The loop length: the number of loops of 0.7 mm to less than 1.2 mm: 78 pieces/m

The loop length: the number of loops of 1.2 mm or more: 0 piece/m

The mightiness: 1125.2 cN (the strength: 4.87 cN/dtex)

As a result, the difference in dye on the bobbin for sewing threads could not be recognized with unaided eyes Furthermore, when the sewability with a high-speed automatic sewing machine was evaluated, the high-speed sewability was up to 4000 needles/min and the back sewability was also able to 4000 needles/min, so that the sewability was excellent.

TABLE 1

| | Example 1 | Example 2 | Example 3 | Comparative Example 1 |
|---|---|---|---|---|
| High-speed sewability needles/min *1 | 4000 | 4500 | 4500 | 3500 |
| Back sewability needles/min *2 | 4000 | 1000 | 1000 | Unable |

*1: larger numeral is better,
*2: smaller numeral is better

Example 2

The sewing thread was produced in the same way as in EXAMPLE 1 except changes in the core yarn overfeed rate to 3%, in the sheath yarn overfeed rate to 13%, and in the sheath-core structure yarn-length difference between the core yarn and the sheath yarn to 10%. The characteristics of this sewing thread are as follows:

The loop length: the number of loops of 0.7 mm to less than 1.2 mm: 142 pieces/m The loop length: the number of loops of 1.2 mm or more: 0 piece/m The mightiness: 997.4 cN (the strength: 4.26 cN/dtex)

When this sewing thread was evaluated as a sewing machine thread in-the same way as in EXAMPLE 1, the high-speed sewability was increased further than in EXAMPLE 1 up to 4500 needles/min and the back sewability was reduced to 1000 needles/min, so that the sewability was in a practically favorable range.

Example 3

The sewing thread was produced in the same way as in EXAMPLE 2 except that a multifilament yarn used for the sheath-core structure yarn is 44 dtex-18 filaments. The characteristics of this sewing thread are as follows:

The loop length: the number of loops of 0.7 mm to less than 1.2 mm: 195 pieces/m The loop length: the number of loops of 1.2 mm or more: 7 pieces/m The mightiness: 816.4 cN (the strength: 4.49 cN/dtex) When this sewing thread was evaluated, in the same manner as in EXAMPLE 2, the high-speed sewability was increased further than in EXAMPLE up to 4500 needles/min and although the back sewability was reduced, but it was 1000 needles/min, so that the sewability was excellent.

Example 4

A polyester multifilament yarn of 44 dtex 18 filaments with a mightiness of 6.1 cN/dtex to be the core yarn and a polyester multifilament yarn of 44 dtex 18 filaments with a mightiness of 6.4 cN/dtex to be the-sheath yarn were used.

The entanglement was performed at a core-yarn overfeed rate of +2.5% and at a sheath-yarn overfeed rate of +8.5% under an air pressure of 4 kg/cm$^2$ so as to produce a combined yarn of 90 dtex 36 filaments at a speed of 400 m/min. As a merging guide for an entangle nozzle, a concave-roll (tsuzumi-drum) shaped guide was used.

The combined yarn produced was under-twisted with 850 t/m in the s direction by a double twister to have the under-twist yarn. The two aligned under-twisted yarns were upper-twisted with 750 t/m in the Z direction so as to produce the double-twisted yarn with an overall fineness of 220 dtex 72 filaments. The double-twisted yarn was thermally set in a drying heater at 180° C. so as to have a boiling-water shrinkage ratio of 2.3%. Then, it was re-reeled on a soft-winding cheese and was dyed in black by cheese dyeing at 130° C. with disperse dye. From the cheese, it was re-reeled on a cone for a sewing thread so as to produce a sewing machine thread.

The characteristics and the sewing evaluation results of the sewing machine thread are shown in Table 2.

As a result, the sewing-machine thread with high strength and beautiful seam lines, as well as excellent in adaptability to automatic sewing machines was obtained. The efficiency in yarn processing of the combined yarn was that a yarn-broken rate of 0.5/16 bobs/24 hr, and the string was uniform.

Examples 5 to 7

A polyester multifilament yarn of 44 dtex 18 filaments with a mightiness of 6.1 cN/dtex to be the core yarn and a polyester multifilament yarn of 44 dtex 18 filaments with a mightiness of 6.4 cN/dtex to be the sheath yarn were used.

The entanglement was performed at a core-yarn overfeed rate of +2.5% and at a sheath-yarn overfeed rate of +4.5% to +10.5% under an air pressure of 4 to 6 kg/cm$^2$ so as to produce a combined yarn of 90 dtex 36 filaments at a yarn running speed of 400 m/min. As the merging guide for the entangle nozzle, a concave-roll (tsuzumi-drum) shaped guide was used.

The combined yarn produced was under-twisted with 850 t/m in the s direction by the double twister to have the under-twist yarn. The two aligned under-twist yarns were upper-twisted with 750 t/m in the Z direction so as to produce the double-twisted yarn with an overall fineness of 220 dtex 72 filaments.

The double-twisted yarn was thermally set in a drying heater at 180° C. so as to have a boiling-water shrinkage ratio of 2.3%. Then, it was re-reeled on a soft-winding cheese and was dyed in black by cheese dyeing at 130° C. with disperse dye. From the cheese, it was re-reeled on a cone for a sewing thread so as to produce a sewing machine thread.

The characteristics and the sewing evaluation results of the sewing machine thread are shown in Table 3.

As a result, the sewing-machine thread with high strength and beautiful seam lines, as well as excellent in adaptability to automatic sewing machines was obtained.

Comparative Example 1

The sewing thread was produced in the same way as in EXAMPLE 1 except that the yarn was combined and entangled without applying the difference in yarn length between two yarns of the multifilament yarn (56 dtex-18 filaments) for use in the sheath-core structure yarn. The characteristics of this sewing thread having loop distribution shown in COMPARATIVE EXAMPLE 1 of FIG. 2 are as follows:

The loop length: the number of loops of 0.7 mm to less than 1.2 mm: 2 pieces/m

The loop length: the number of loops of 1.2 mm or more: 0 piece/m

The mightiness: 1143.8 cN (the strength: 5.56 cN/dtex)

Although this sewing thread has high yarn mightiness, since it is no yarn-length difference, the number of loops of more than 0.7 mm is extremely small. When the sewability of this sewing thread was evaluated, the high-speed sewability is 3500 needles, which is slightly lower than that according to the present invention, and the back sewability cannot be measured under the evaluation conditions, so that the sewability is extremely low.

Comparative Example 2

On the basis of the producing method described in Japanese Unexamined Patent Application Publication No. 5-106134, a polyester multifilament yarn of 44 dtex 18 filaments with a mightiness of 6.1 cN/dtex to be the core yarn and a polyester multifilament yarn of 44 dtex 18 filaments with a mightiness of 6.4 cN/dtex to be the sheath yarn were used.

The entanglement was performed at a core-yarn overfeed rate of +0.5% and at a sheath-yarn overfeed rate of +3.0% under an air pressure of 4 kg/cm$^2$ so as to produce a combined yarn of 89 dtex 36 filaments at a yarn running speed of 400 m/min. The combined yarn was produced using a general entangle nozzle without a merging guide. Then, the sewing machine thread was produced in the same way as in EXAMPLE 1, and the characteristics and the sewing evaluation results of the sewing machine thread are shown in Table 2.

TABLE 2

| | Example 4 | Comparative Example 2 |
|---|---|---|
| Producing conditions | | |
| Overfeed rate (%) | | |
| Core yarn | +2.5 | +0.5 |
| Sheath yarn | +8.5 | +3.0 |
| Air pressure (kg/cm$^2$) | 4 | 4 |

TABLE 2-continued

| | Example 4 | Comparative Example 2 |
|---|---|---|
| Evaluation items | | |
| Apparent fineness (dtex) | 220.4 | 205.0 |
| Tensile strength (cN/dtex) | 3.9 | 4.5 |
| Hooking strength (cN/dtex) | 3.4 | 3.5 |
| Hooking-strength availability (%) | 87.2 | 77.8 |
| Shrinkage ratio (%) | | |
| Dry-heat | 2.3 | 2.5 |
| Boiling-water | 0.2 | 0.5 |
| Number of entangles (pieces/m) | 135 | 46 |
| Yarn-length difference (%) | 4.0 | 1.7 |
| Number of loops (pieces/m) | 251 | 5 |
| Overall evaluation of sewing machine thread | ◎ | Δ |
| High-speed sewability | 5000 | 3000 |
| Automatic sewing-machine adaptability | ◎ | ○ to Δ |
| Seam quality | ○ | ◎ |
| Overall evaluation of sewability | ◎ | Δ to x |

TABLE 3

| | Example 5 | Example 6 | Example 7 |
|---|---|---|---|
| Producing conditions | | | |
| Overfeed rate (%) | | | |
| Core yarn | +2.5 | +2.5 | +2.5 |
| Sheath yarn | +4.5 | +8.5 | +10.5 |
| Air pressure (kg/cm$^2$) | 4 | 6 | 4 |
| Evaluation items | | | |
| Apparent fineness (detex) | 209 | 221 | 235 |
| Tensile strength (cN/dtex) | 4.7 | 3.7 | 3.6 |
| Hooking strength (cN/dtex) | 4.1 | 3.2 | 3.1 |
| Hooking-strength availability (%) | 87.2 | 86.4 | 86.1 |
| Number of entangles (pieces/m) | 101 | 146 | 155 |
| Yarn-length difference (%) | 3.0 | 4.1 | 5.4 |
| Number of loops (pieces/m) | 157 | 260 | 287 |
| Overall evaluation of sewing machine thread | ○ | ○ | ○ |
| High-speed sewability | 4000 | 5000 | 5000 |
| Automatic sewing-machine adaptability | ○ | ◎ | ○ |
| Seam quality | ○ | ○ | ○ to Δ |
| Overall evaluation of sewability | ○ | ◎ | ○ |

The sewing evaluation method in Table 2 is as follows:

The high-speed sewability: ten sheets of cotton broad cloth # 4000 (made from NISSHINBO INDUSTRIES, INC.) overlapped on each other was tested using a sewing machine capable of sewing a distance of 2 m (JUKI DDL-5571N) in a range of the maximum rotational speed of 1000 to 5000 needles/min.

The needle No.: DBI-# 11 used

The automatic sewing-machine adaptability: the tension range capable of sewing four sheets of cotton C broad cloth at 1500 needles/min in a distance of 2 m was tested.

×; unable to be sewn

Δ; sewable (uncertain tension range)

o; 100 to 200 g

⊙; 50 to 300 g

The seam quality: visual inspection

Δ; loop recognizable o; unnoticeable

⊙; no loop

The overall determination: intercomparison evaluation

×; inferior

Δ; not good o; good

⊙; excellent

In the overall determination of the sewing machine thread in EXAMPLE 5, the hooking-strength availability is at a high level of 80% so that the seam mightiness is strongly maintained. Since the number of entangles is 100 pieces/m or more, the yarn is difficult to be twist-divided into the core yarn and to sheath yarn. Because the yarn-length difference is 2% or more and the yarn is bulky, increase in machine needle temperature is suppressed, obtaining high-speed sewability.

Since the apparent number of loops is 200 pieces/m or more, it is replaceable with a fluffed yarn, so that accompanying airflow effect, annealing effect of needle heat, and reduction in the frictional force between the needle and cloth are large, and the adaptability of sewability to automatic sewing machines is excellent.

In the overall determination of sewability, the high-speed sewability and the adaptability to automatic sewing machines are especially excellent.

In the overall determination of the sewing machine thread in COMPARATIVE EXAMPLE 2, since the thread is produced with a conventional entangle nozzle, the number of entangles, the yarn-length difference, and the number of loops are small, so that the high-speed sewability and the adaptability to automatic sewing machines are low.

In EXAMPLE 6, when the overfeed rate of the sheath yarn is reduced smaller than that of EXAMPLE 4 while the number of entangles, the yarn-length difference, and the number of loops are reduced slightly smaller, the high-speed sewability is slightly reduced, and although the overall determination is reduced rather than EXAMPLE 4, it is at a level higher than that of COMPARATIVE EXAMPLE 2.

In EXAMPLE 7i when the overfeed rate of the sheath yarn is increased larger than that of EXAMPLE 4 while the number of entangles, the yarn-length difference, and the number of loops are increased, the seam quality is slightly reduced, and although the overall determination is reduced rather than EXAMPLE 4, it is at a level higher than that of COMPARATIVE EXAMPLE 2.

INDUSTRIAL APPLICABILITY

In a sewing machine thread according to the present invention, since a sheath yarn is formed around a core yarn to uniformly have slack or loops, string of the sewing machine thread is smooth, and variations in yarn unreeling tension and broken threads are reduced in sewing so as to improve sewability.

Also, because of the uniform string, seam is beautifully finished so as to produce sewn products excellent in appearance.

The fineness is fine and the mightiness is high in the sewing machine thread according to the present invention, so that when the fineness is 250 dtex or less in particular, the yarn strength ranges from 3.5 to 5.0 cN/dtex so as to have very excellent durability.

Furthermore, owing to loops, suppression in the frictional heat between the needle and cloth and annealing effect of needle heat due to accompanying airflow improve sewability, and the high-speed sewability is particularly excellent.

As is apparent from the sewing evaluation shown in Table 2, the sewing machine thread according to the present invention is excellent in principal sewing functions, such as the high-speed sewability, adaptability to automatic sewing machines, and beautiful seam, and it is characterized by a well-balanced sewing machine thread.

The invention claimed is:

1. A sewing thread comprising a plurality of under-twisted yarns, each of the under-twisted yarns being a sheath-core structure yarn composed of a sheath yarn comprising sheath filaments and a core yarn comprising core filaments, the sewing thread having an upper-twist therein, wherein a part of the sheath-core structure yarn protrudes as loops on a surface of the sewing thread, the loops with 0.7 to less than 1.2 mm length are 50 to 300 loops per meter, and the loops with 1.2 mm or more length are 10 or less loops per meter.

2. The thread according to claim 1, wherein the sewing thread has a strength of 4 to 6 cN/dtex.

3. The thread according to claim 1, wherein a difference in yarn length between a core yarn and a sheath yarn of the sheath-core structure yarn is in the range of 2 to 20%.

4. The thread according to claim 1, wherein a difference in yarn length between a core yarn and a sheath yarn of the sheath-core structure yarn is in the range of 3 to 10%.

5. The thread according to claim 1, wherein an average rate of variations in sewing tension of the thread is within ±10%.

6. The thread of claim 1, wherein the thread comprises 2-7 under-twisted yarns.

7. The thread of claim 1, wherein the under-twist and the upper-twist are in different directions.

8. The thread of claim 1, wherein the thread has a twist coefficient between 4000 and 12000.

9. The thread of claim 1, wherein the sheath-core structure yarn comprises two or more multifilament yarns.

10. The thread of claim 1, wherein the sheath yarn and the core yarn of each of the under-twisted yarns have a difference in yarn length.

11. The thread of claim 1, wherein the thread comprises two multifilament under-twisted yarns.

* * * * *